US005250139A

United States Patent [19]

Hall

[11] Patent Number: 5,250,139

[45] Date of Patent: Oct. 5, 1993

[54] LIGHTED BONDING IRON

[76] Inventor: David W. Hall, 6 Orchard La., Huntington, Ind. 46750

[21] Appl. No.: 846,961

[22] Filed: Mar. 6, 1992

Related U.S. Application Data

[63] Continuation of Ser. No. 563,525, Aug. 6, 1990, abandoned.

[51] Int. Cl.[5] ..... B32B 31/00; D06F 75/36

[52] U.S. Cl. ..... 156/379; 156/304.7; 156/579; 219/245; 38/88; 38/94

[58] Field of Search ..... 156/304.4, 304.7, 379, 156/579; 38/75, 88, 94; 219/245; 126/411; 15/324

[56] References Cited

U.S. PATENT DOCUMENTS

| | | | |
|---|---|---|---|
| 2,607,139 | 8/1952 | Snyder et al. | 38/75 X |
| 2,613,459 | 10/1952 | Almquist | 38/75 |
| 2,624,832 | 1/1953 | Moyer | 38/75 X |
| 2,682,604 | 6/1954 | Gerber | 15/324 X |
| 4,536,244 | 8/1985 | Greci et al. | 156/304.4 |
| 4,584,040 | 4/1986 | Anderson | 156/304.4 X |
| 4,617,083 | 10/1986 | Yrizarris | 156/545 |
| 4,726,867 | 2/1988 | Gustarsen | 156/304.4 |

*Primary Examiner*—David A. Simmons
*Assistant Examiner*—J. Sells
*Attorney, Agent, or Firm*—Lundy & Associates

[57] ABSTRACT

A lighted bonding iron having a heating unit which defines a plane. A handle is mounted to the heating unit. First and second light sources are incorporated in the handle. The light sources project nonintersecting beams obliquely toward the plane.

21 Claims, 3 Drawing Sheets

LIGHTED BONDING IRON

This is a continuation of co-pending application Ser. No. 07/563,525 filed on Aug. 6, 1990, abandoned.

BACKGROUND OF THE INVENTION

The present invention pertains to lighted hand irons and other portable plate type heaters and more particularly pertains to a lighted bonding iron.

Heat activated adhesives are being used more and more in construction and manufacturing. In applying carpet or other sheet materials to surfaces irons are used to both heat interposed bonding material and to ensure full contact between the surface and sheet material while the bonding material is hot. In many factory environments adequate lighting is readily available, however, in other environments, such as bonding of carpet in a closet or new construction, adequate lighting is often unavailable or impractical.

It is therefore highly desirable to provide an improved lighted bonding iron.

It is also highly desirable to provide an improved lighted bonding iron which provides light to both the front and rear.

It is also highly desirable to provide an improved lighted bonding iron which provides light close to the iron and at a high angle of incidence.

It is also highly desirable to provide an improved lighted bonding iron which provides light at two different angles of incidence.

It is also highly desirable to provide an improved lighted bonding iron which incorporates lamps positioned so as to be protected against impacts and yet is unobstructed during use.

It is finally highly desirable to provide an improved lighted bonding iron which meets all of the above desired features.

SUMMARY OF THE INVENTION

It is an object of the invention to provide an improved lighted bonding iron.

It is another object of the invention to provide an improved lighted bonding iron which provides light to the front and rear.

It is another object of the invention to provide an improved lighted bonding iron which provides light close to the iron and at a high angle of incidence.

It is another object of the invention to provide an improved lighted bonding iron which provides light at two different angles of incidence.

It is another object of the invention to provide an improved lighted bonding iron which incorporates lamps positioned so as to be protected against impacts and yet is unobstructed during use.

It is finally an object of the invention to provide an improved lighted bonding iron which provides all of the above objects.

In the broader aspects of the invention there is provided a lighted bonding iron having a heating unit which defines a plane. A handle is mounted to the heating unit. First and second light sources are incorporated in the handle. The light sources project nonintersecting beams obliquely toward the plane.

BRIEF DESCRIPTION OF THE DRAWINGS

The above-mentioned and other features and objects of the invention and the manner of attaining them will become more apparent and the invention itself will be better understood by reference to the following description of an embodiment of the invention taken in conjunction with the accompanying drawings wherein.

DESCRIPTION OF A SPECIFIC EMBODIMENT

Figure 1:
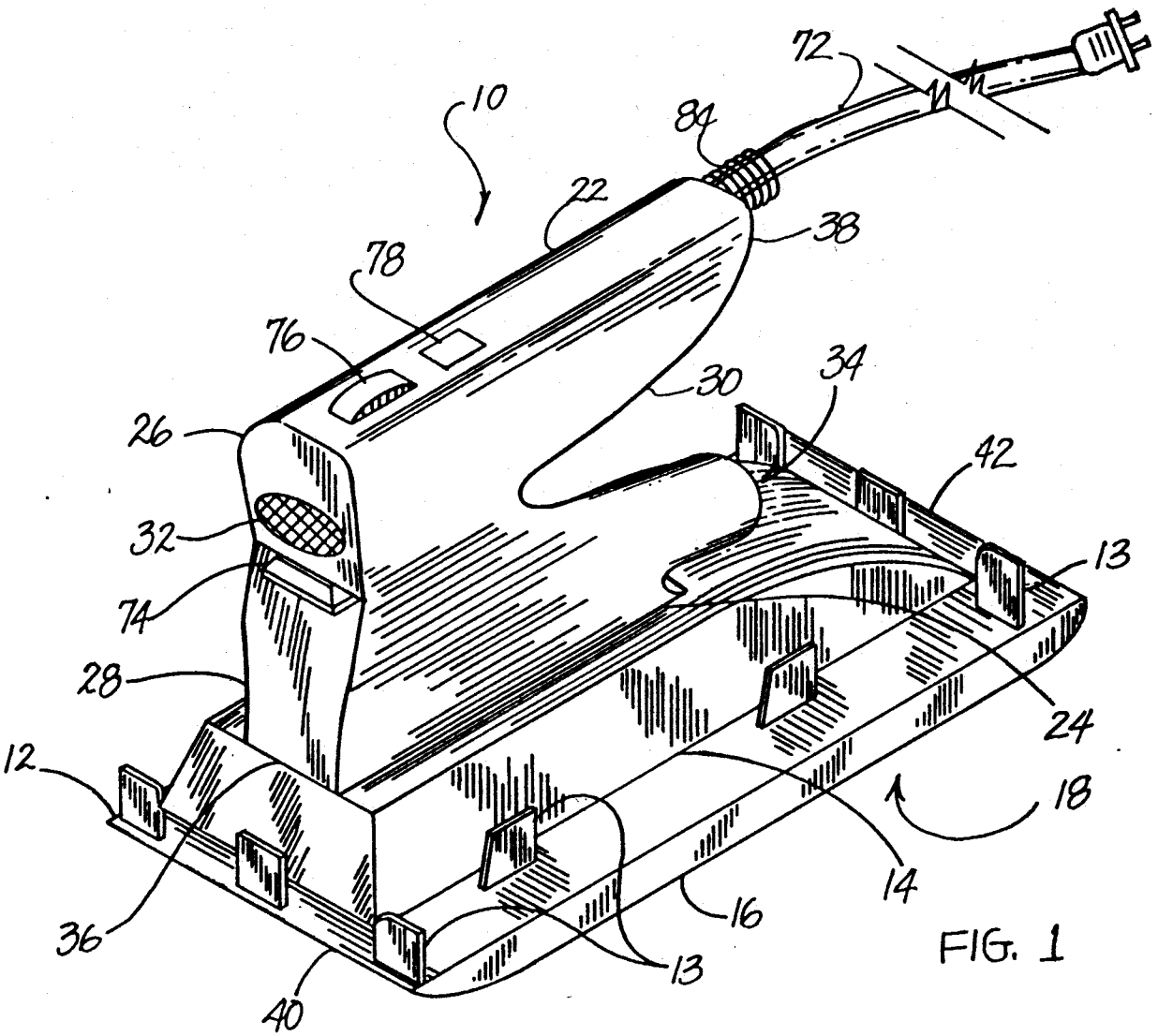
FIG. 1 is a perspective view of an embodiment of the lighted bonding iron of the invention.

The lighted bonding iron 10 of the invention has a heating unit 12, which includes a shell 14 and a sole 16, joined to shell by tabs 13. Enclosed within shell 14 is an electrical heating element 15. Sole 16 has a bottom 18, which defines a plane 20, as shown in FIG. 2.

Extending up from heating unit 12 opposite sole 16 is a handle 22 made of heat insulating material. Handle 22 includes a base 24 and a grip 26. Base 24 is joined to heating unit 12 and extends most of the length of heating unit 12. Grip 26 has a stem 28, which extends upward from and is continuous with base 24, and a longitudinal portion 30, which extends out from stem 28. Longitudinal portion is also continuous with stem 28. Longitudinal portion 30 is generally parallel to base 24 and is configured so as to be grasped by the user. Base 24 protects the user's hand from unintended contact with heating unit 12, but may become unacceptably warm during use. Longitudinal portion 30 is therefore separated from base 24 by a distance sufficient to permit longitudinal portion 30 to be grasped without contacting base 24.

Incorporated in handle 22 are horizontally opposed, front and rear light sources 32, 34, respectively. Rear light source 34 is incorporated in base 24 and faces to the rear and downward. Front light source 32 is incorporated in grip 26 and faces forward and downward. Light sources 32, 34 are vertically spaced apart and rear light source 34 is also vertically spaced apart from longitudinal portion 30 of handle 22. Light sources 32, 34 are inset from respective front or rear margins 36, 38, respectively, of handle 22 and handle 22 is inset from front and rear ends, 40, 42, respectively, of heating unit 12. In a particular embodiment of the invention, the inset of rear light source 34 from rear end 42 is about double the inset of front light source 32 from front end 40.

Figure 2:
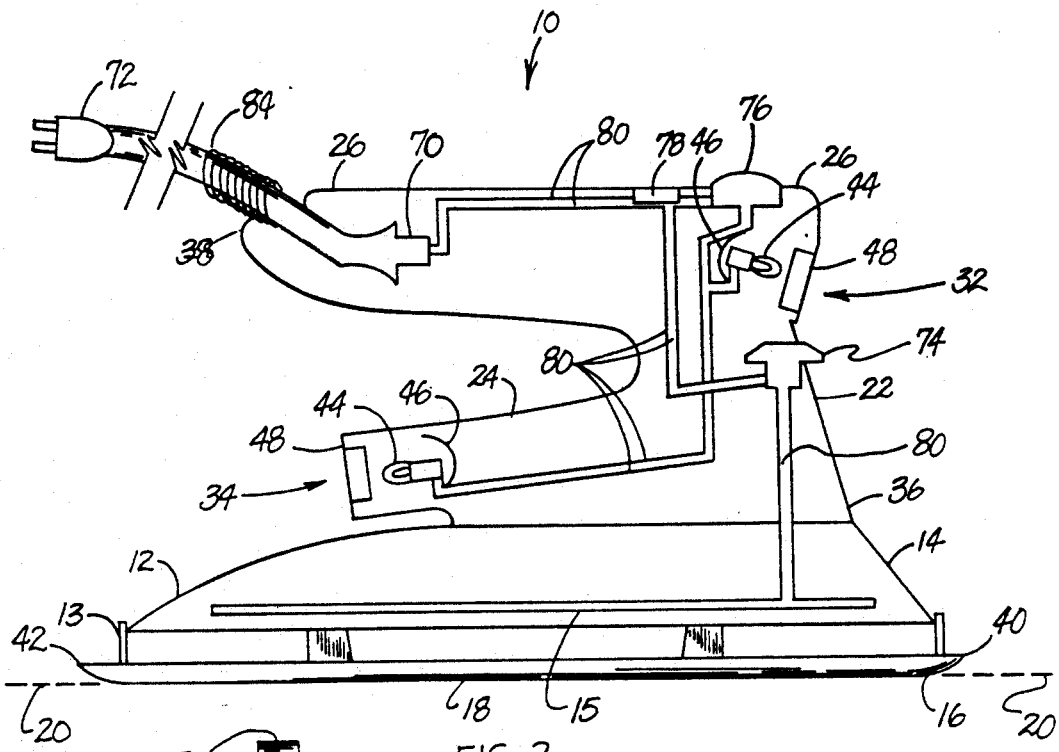
FIG. 2 is a semi-diagrammatical side plan view of the lighted bonding iron of FIG. 1.
Figure 3:
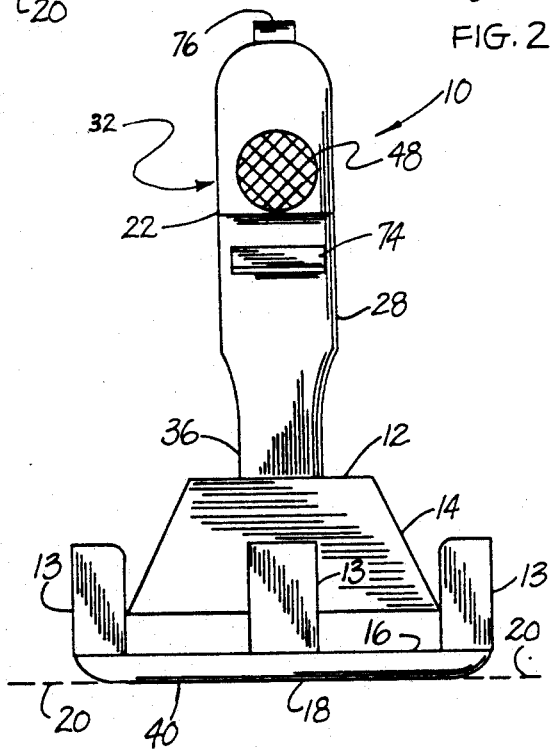
FIG. 3 is a front plan view of the lighted bonding iron of FIG. 1.
Figure 4:
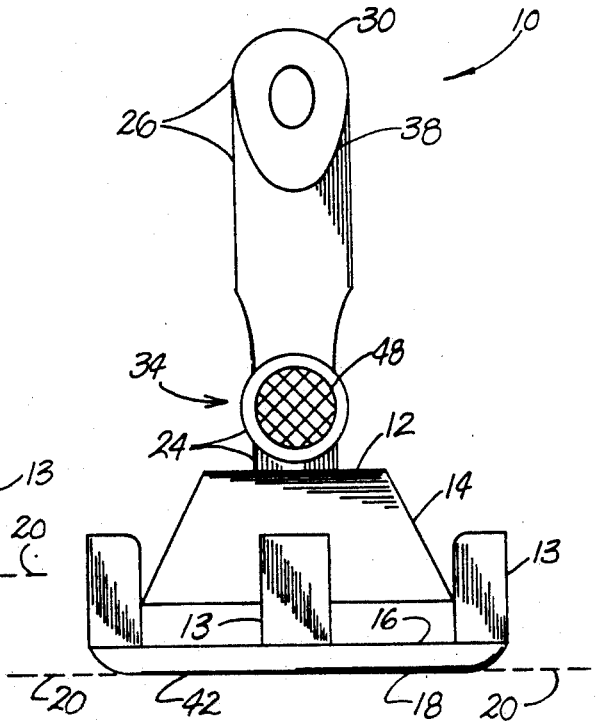
FIG. 4 is a rear plan view of the lighted bonding iron of FIG. 1. The electrical cord is deleted for clarity.
Figure 5:
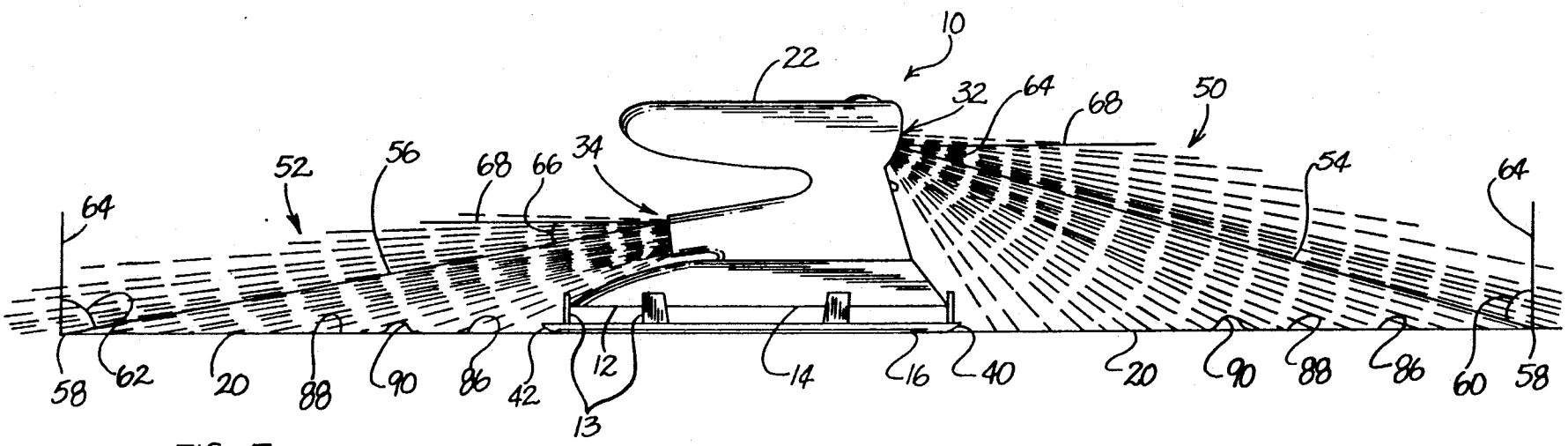
FIG. 5 is a diagrammatical side plan view of the lighted bonding iron of FIG. 1 disposed on bonding material on a support surface. Front and rear beams are indicated by dashed lines. Beam axes are indicated by solid lines.

Referring now particularly to FIGS. 2 and 5, internal characteristics of light sources 32, 34 may be as simple as incandescent lamps 44 and reflectors 46 positioned immediately behind individual lenses 48. Each light source 32, 34 supplies light through a respective lens 48, in the form of a divergent beam 50, 52, respectively, having a central axis 54, 56, respectively. Beams 50, 52 strike plane 20 obliquely, in front of and behind heating unit 12, respectively. Beam axes 54, 56 impinge plane 20 at points of impingement 58 about equally separated from heating unit 12. In a particular embodiment of the invention, the point of impingement 58 of each beam 50, 52 on plane 20 is at a horizontal separation of between about 12 and about 17 inches from respective ends 40, 42.

Referring now particularly to FIG. 5, rear beam 52 illuminates plane 20 more nearly from the side than front beam 50, since rear light source 34 is more inset and is mounted more nearly horizontal than front light source 32. This feature may be described in terms of the angles of incidence 60, 62 of beam axes 54, 56, respectively, to plane 20, or more correctly to vertical lines 64 through points of impingement 58 on plane 20. Angles of incidence 60, 62 differ in absolute value. Stated another way, axes 54, 56 define differing included angles of declination 64, 66, respectively, from horizontal, indicated in FIG. 5 by horizontal lines 68. The angle of incidence 60, 62 and included angle of declination 64, 66 of a beam axis 54, 56, all respectively, are related and if added together equal ninety degrees. Beam axis 56 of rear light source 34 has an angle of incidence 62 of greater than about 65 degrees or more desirably, greater than 80 degrees. The angle of incidence 60 of front beam axis 54 is greater than that of rear beam axis 56. The included angle of declination 64 of front beam axis 54 may be double the included angle of declination 66 of rear beam axis 56. In a particular embodiment of the invention, the angles of incidence 60, 62 of beam axes 54, 56 are about 82 degrees and about 73 degrees, all respectively. Included angles of declination 64, 66, in that same embodiment of the invention, are about 8 degrees and about 17 degrees, respectively.

Referring now particularly to FIG. 2, handle 22 includes a connector 70 for an electrical cord 72 and controls including a temperature control 74, a light source switch 76, and a pilot light 78. Conductors 80 connect electrical cord 72 and controls 74, 76, 78 to lamps 44 and heating element 15. Cord 72 may be provided with a coil spring 84 or other stiffening means to ensure that cord 72 does not trail in rear beam 52.

Referring now particularly to FIG. 2, in use, cord 72 of lighted bonding iron 10 is connected to electrical mains and light sources 32, 34 are actuated if needed. Lighted bonding iron 10 is then slid or otherwise moved along bondable material 86 resting on a support surface, illustrated in FIG. 5 as coincident with plane 20. Pressure is applied as needed. Heating unit 12 is strong and light sources 32, 34 are inset from front and rear ends 40, 42 of heating unit 12 to withstand impacts. The motion used is preferably longitudinal or has a longitudinal component, so that front or back end 40, 42 faces the direction of motion and light sources 32, 34 can be utilized in the manner of automobile headlights the path of motion. Motion in other horizontal directions may also be used, unless precluded by the shapes of sole 16 and support surface 88.

As lighted bonding iron 10 is moved forward, front beam 50 illuminates unironed bondable material 86 and rear light source 34 illuminates ironed bondable material 86. Beams 50, 52 strike bondable material 86 at a separation from heating unit 12 of a distance sufficient to ensure that the view of the brightest portion of beams 50, 52 is not obstructed by the iron 10 itself, while at the same time lighting the areas of bondable material 86 immediately ahead and behind heating unit 12.

Rear light source 34 produces a beam 52 having an axis 56 at a very low included angle of declination 66 from horizontal. The inset of rear light source 34 blocks a portion of rear beam 52, which most departs from the included angle of declination 66 of axis 56. The result of the inset and inclination of rear beam 52 is to exaggerate shadow 88 lengths of folds or other discontinuities 90 of bondable material 86 in the same manner that the setting sun lengthens shadows.

Front light source 32 is less inset than rear light source 34 and is mounted vertically higher and at a greater included angle of declination 64. Front beam 50 causes discontinuities to throw shadows 88, but the shadows 88 are shorter than in rear beam 52, particularly near front end 40.

Unironed bondable material 86, in front of lighted bonding iron 10, is likely to have larger dicontinuities 90 than ironed bondable material 86 to the rear and very long shadows 88 would be likely to present a confusing image. At the rear, discontinuities 90 are likely to be small and highly exaggerated shadows 88 are needed to permit rapid detection. The differing insets, included angles of declination 64, 66 of front and rear beams 50, 52 and their opposite horizontal directions, help assure that discontinuities 90 of bondable material 86, which might be concealed if only illuminated by a single beam, will be found, reironed and eliminated.

The improved lighting bonding iron of the invention provides light to both the front and the rear of the bonding iron at a high angle of incidence, close to the iron, and at two different angles of incidence. The lights are protected against impact and yet are unobstructed during use. The improved bonding iron provides light which allows the user even in the darkest of places to see any discontinuous portions of the material being bonded, such that they can be corrected prior to finalizing the bonding process.

While a specific embodiment of the invention has been shown and described herein for purposes of illustration, the protection afforded by any patent which may issue upon this application is not strictly limited to the disclosed embodiment; but rather extends to all structures and arrangements which fall fairly within the scope of the claims which are appended hereto.

What is claimed is:

1. A lighted bonding iron apparatus comprising an outer shell having a front portion, a rear portion, and a substantially horizontal handle portion fixably mounted from said front portion, a heating element forming a horizontal planer ironing surface beneath said outer shell, a first light source fixably mounted in said front portion in proximity to said handle portion, and positioned to illuminate the area adjacent to said front portion, a second light source fixably mounted in said rear portion of said outer shell, at a location beneath the handle portion, and positioned to illuminate the area adjacent to said rear portion, and a means for illuminating said first and second light source.

2. The lighted bonding iron of claim 1 wherein said first and second light sources are seam shadow creating light sources projecting nonintersecting generally horizontally opposed beams obliquely toward said horizontal planer ironing surface.

3. The lighted bonding iron of claim 1 wherein said heating element has forward and rear ends and said beams are projected by said seam shadow creating light sources in front of and behind said heating element.

4. The lighted bonding iron of claim 3 wherein the axes of said beams projected by said seam shadow creating light sources have angles of incidence to said horizontal planar ironing surface differing in absolute value.

5. The lighted bonding iron of claim 4 wherein the axes of said beams each impinge said horizontal planar ironing surface plane between about 12 and about 17 inches from said heating unit element whereby seam shadows are created.

6. The lighted bonding iron of claim 3 wherein said handle portion further comprises a base and a grip, said base being mounted to said heating element, said grip being joined to said base, said first seam shadow creating light source being incorporated in said grip, said second seam shadow creating light source being incorporated in said base.

7. The lighted bonding iron of claim 6 wherein said grip has a longitudinal portion and a stem and said first seam shadow creating light source is vertically spaced apart from said longitudinal portion.

8. The lighted bonding iron of claim 1 wherein the axes of said beams projected by said seam shadow creating light sources have angles of incidence to said horizontal planer ironing surface differing in absolute value.

9. The lighted bonding iron of claim 8 wherein the axes of said beams each impinge said horizontal planer ironing surface between about 12 and about 17 inches from said heating element whereby seam shadows are created.

10. The lighted bonding iron of claim 1, wherein said seam shadows creating light sources each project the center of a respective said beam at a point on said horizontal planer ironing surface between about 12 and about 17 inches from said heating element.

11. The lighted bonding iron of claim 10 wherein said seam shadow creating light sources are spaced apart in a direction perpendicular to said horizontal planer ironing surface.

12. The lighted bonding iron of claim 10 wherein the axis of one of said beams has an angle of incidence to said horizontal planer ironing surface greater than about 65 degrees.

13. The lighted bonding iron of claim 10 wherein the axis of one of said beams has an angle of incidence to said horizontal planer ironing surface greater than about 80 degrees.

14. The lighted bonding iron of claim 10 wherein the center of one of said beams has an angle of incidence to said horizontal planer ironing surface less than 80 degrees and the other said beam has an angle of incidence to said horizontal planer ironing surface between about 80 degrees and 90 degrees.

15. A lighted bonding iron for use in installing carpets having seams comprising an outer shell having a front portion, a rear portion, and a substantially horizontal handle portion fixably mounted from said front portion, a heating element forming a horizontal planer ironing surface beneath said outer shell, a first light source fixably mounted in said front portion in proximity to said handle portion, and positioned to illuminate the area adjacent to said front portion, a second light source fixably mounted in said rear portion of said outer shell, at a location beneath the handle portion, and positioned to illuminate the area adjacent to said rear portion, and a means for illuminating said first and second light sources, said light sources projecting a pair of horizontally opposed beams obliquely downwardly, whereby seam shadows are created.

16. The lighted bonding iron of claim 15 wherein said beams have axes defining included angles of declination from horizatonal of less than about 20 degrees.

17. The lighted bonding iron of claim 16 wherein said beams have axes defining differing included angles of declination from horizontal.

18. The lighted bonding iron of claim 17 wherein the included angle of declination of said beam from said first seam shadow creating light source is about double the included angle of declination of said beam from said second seam shadow creating light source.

19. The lighted bonding iron of claim 18 wherein said handle portion has front and rear margins and said seam shadow creating light sources are inset from respective said margins, said rear light source being inset about twice as far as said front light source.

20. A lighted bonding iron for use in installing carpets having seams comprising an outer shell having a front portion, a rear portion, and a substantially horizontal handle portion fixably mounted from said front portion, a heating element forming a horizontal planer ironing surface beneath said outer shell, a first light source fixably mounted in said front portion in proximity to said handle portion, and positioned to illuminate the area adjacent to said front portion, a second light source fixably mounted in said rear portion of said outer shell, at a location beneath the handle portion, and positioned to illuminate the area adjacent to said rear portion, and a means for illuminating said first and second light sources, said first and sacond light sources projecting a pair of beams impinging said horizontal planer ironing surface at about equal separations and generally horizontally opposed directions from said heating element.

21. The lighted bonding iron of claim 20 wherein said light sources are vertically spaced apart and said beam projected by said second light source has an axis having an angle of incidence to said horizontal planer ironing surface greater than about 80 degrees and said beam projected by said first light source has an axis having an angle incidence to said horizontal planer ironing surface less than about 80°.

* * * * *